US006480119B1

(12) United States Patent
McElhinney

(10) Patent No.: US 6,480,119 B1
(45) Date of Patent: Nov. 12, 2002

(54) SURVEYING A SUBTERRANEAN BOREHOLE USING ACCELEROMETERS

(75) Inventor: Graham McElhinney, Aberdeenshire (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/377,572

(22) Filed: Aug. 19, 1999

(51) Int. Cl.[7] ..... G01V 3/00

(52) U.S. Cl. ..... 340/853.8; 340/853.1; 175/40; 702/6; 33/304

(58) Field of Search ..... 340/853.8, 853.1; 33/302, 304; 175/40; 702/6

(56) References Cited

U.S. PATENT DOCUMENTS

| | | | | | |
|---|---|---|---|---|---|
| 4,231,252 | A | * | 11/1980 | Cherkson | 33/313 |
| 4,472,884 | A | * | 9/1984 | Engebretson | 33/304 |
| 4,510,696 | A | * | 4/1985 | Roesler | 33/304 |
| 4,559,713 | A | * | 12/1985 | Ott et al. | 33/302 |
| 4,709,486 | A | * | 12/1987 | Walters | 33/304 |
| 4,906,388 | A | * | 3/1990 | Cain et al. | 210/771 |
| 4,909,336 | A | * | 3/1990 | Brown et al. | 175/45 |
| 4,987,684 | A | * | 1/1991 | Andreas et al. | 33/304 |
| RE33,708 | E | * | 10/1991 | Roesler | 33/304 |
| 5,410,303 | A | * | 4/1995 | Comeau et al. | 175/40 |
| 5,435,069 | A | * | 7/1995 | Nicholson | 33/304 |
| 5,623,407 | A | * | 4/1997 | Brooks | 702/6 |
| 5,657,547 | A | * | 8/1997 | Uttecht et al. | 33/302 |
| 5,657,826 | A | * | 8/1997 | Kuckes | 175/45 |
| 5,739,431 | A | * | 4/1998 | Petri | 324/260 |
| 5,787,997 | A | * | 8/1998 | Hartmann | 175/45 |
| 5,821,414 | A | * | 10/1998 | Noy et al. | 33/304 |
| 5,970,787 | A | * | 10/1999 | Wignall | 73/152.54 |
| 6,109,370 | A | * | 8/2000 | Gray | 175/215 |
| 6,179,067 | B1 | * | 1/2001 | Brooks | 175/45 |
| 6,347,282 | B2 | * | 2/2002 | Estes et al. | 702/6 |

* cited by examiner

*Primary Examiner*—Michael Horabik
*Assistant Examiner*—Albert K. Wong
(74) *Attorney, Agent, or Firm*—William E. Shull; Micahel D. McCully

(57) ABSTRACT

A method and apparatus for surveying a subterranean borehole is disclosed which uses two sets of accelerometers joined by a joining structure which prevents relative rotation between the two sets, the whole apparatus being arranged to permit movement along a borehole to one or more survey positions. Each set of accelerometers measures the gravity in at least two directions at its respective positions, and then from these measured values it is possible to calculate the borehole inclination and azimuth. The present invention is particularly suitable for use in areas with high magnetic interference, or for measuring boreholes with low inclinations. Tests of the present invention shows that an accuracy similar to that obtained by gyro surveys was achievable.

17 Claims, 2 Drawing Sheets

View showing Inclination of Top and Lower sets

SURVEYING A SUBTERRANEAN BOREHOLE USING ACCELEROMETERS

FIELD OF THE INVENTION

The present invention relates to surveys in a subterranean borehole for determining the spatial co-ordinates of its path. More particularly, the present invention relates to determining the spatial coordinates and hence the azimuth of a borehole using accelerometers.

BACKGROUND OF THE INVENTION

Within the prior art accelerometers have been used for determining gravity at a particular point (G), inclination, rotation and the horizontal plane. Frequently magnetometers or gyroscopes combined with the accelerometers are used to determine direction. There are situations when magnetometers are affected by sources of magnetic interference like nearby magnetic steel, electromagnetic radiation and ferric minerals in formations or ore bodies. The main cause of concern from these sources is the deflection of the Azimuth readings obtained from the magnetometers, which the magnetic interference can cause. The Azimuth is also affected by the so-called "Drill string interference". Although it is called drill string interference the cause of this magnetism is mainly from motors and stabilisers. Motors and stabilisers often are permanently magnetized during magnetic particle inspection processes. While the motors and stabilisers are generally degaussed following inspection, the degaussing process is frequently inadequate, resulting in accumulation of magnetic interference from use to use.

As mentioned above, gyroscopes have also been used as surveying instruments in the prior art. Gyroscopes can be considered to be more complex instruments than the others mentioned and due to increasing time dependent errors frequently have to be re-referenced and protected from high temperatures and vibration. Furthermore, gyroscopes possess a significant disadvantage in that at low angles of inclination the azimuth is variable. At higher inclination angles this effect stabilises. A consequence is that gyro's cannot give direction or tool face direction at low inclinations. To kick a well off at low inclination in a specific direction, is not possible with a gyro. A gyro needs a few degrees inclination in the hole before it can determine the well and tool face direction. When the well builds to an angle that the gyro's can use it may be in the wrong direction. This then has to be corrected and wastes valuable steer-able footage.

SUMMARY OF THE PRESENT INVENTION

In order to overcome the above described problems of the prior art borehole surveying techniques, it is an object of the present invention to provide the Inclination and Azimuth of a borehole without the use of magnetometers or gyroscopes by instead using accelerometers. As accelerometers are responsive to the Earth's gravity they are immune to the sources of interference which affect magnetometers and gyroscopes, and hence the use of accelerometers frees the measurement system from the constraints of these devices. The result is a less complex, more rugged apparatus for determining the borehole position.

According to the present invention, there is provided a method of surveying a borehole to determine at least the inclination and azimuth of said borehole at one or more survey positions along said borehole, comprising the steps of:

a) aligning at least one of a first or second set of gravity measurement means with a reference azimuth;

b) moving said first and second sets of gravity measurement means along said borehole until said first set rests at a survey position and said second set rests at another position, the movement being such that a rotational orientation between said first and second sets of gravity measurement means about a first axis along said borehole is maintained;

c) measuring a first set of two or more gravity vectors at said first survey position with said first set of gravity measurement means, said first set of gravity vectors being mutually perpendicular;

d) measuring a second set of two or more gravity vectors at said other position with said second set of gravity measurement means, said second set of gravity vectors being mutually perpendicular; and e) calculating the inclination and azimuth of said borehole at said first survey position from said first and second sets of gravity vector measurements;

wherein steps b) to e) may be repeated at said one or more survey positions such that the borehole may be surveyed along the length of the borehole.

Furthermore, the present invention also provides an apparatus for surveying a borehole to determine at least the inclination and azimuth of said borehole at one or more survey positions along said borehole, comprising:

a first set of gravity measurement means arranged to measure a first set of two or more gravity vectors, said first set of gravity vectors being mutually perpendicular;

a second set of gravity measurement means arranged to measure a second set of two or more gravity vectors, said second set of gravity vectors being mutually perpendicular;

a joining structure arranged to join said first and second set of gravity measurement means to prevent any relative rotation therebetween; and processing means arranged to calculate the azimuth and inclination of the borehole at the survey position from the gravity vectors measured by the first and second set of gravity measurement means;

wherein said apparatus is further arranged so as to permit movement of said apparatus along said borehole, a long axis of said joining structure being co-axial with said borehole along the length of said borehole.

Each set of gravity measurement means may measure two or preferably three mutually perpendicular gravity vectors. Where only two gravity vectors are measured a corresponding third gravity vector for each set is found by a consideration of the known local total gravitational field, and solving for the unknown third vector from this known local total value.

With respect to alignment of the gravity measurement means, the alignment may be performed before the gravity measurement means are run into the borehole, the alignment then being maintained as the means are run into said borehole. Alternatively, alignment of the means may be achieved by aligning at least one of the sets of gravity measurement means with a part of the borehole with a known azimuth. Either or both of the first and second sets of gravity measurement means may be aligned with the reference azimuth, although where only one of the sets is aligned, then the rotational offset between the two sets of gravity measurement means must be known. Preferably, there is no rotational offset between the two sets of gravity measurement means, and the two sets of means are rotationally aligned about long axis of the borehole.

The distance between the two sets of gravity measurement means defined by the joining structure may be constant, or may instead be variable. Where the distance is variable along the borehole it is preferable that the distance be known at all times. In a preferred embodiment, the first and second gravity measurement means each preferably comprise two or more mutually perpendicular accelerometers, each accelerometer being arranged to measure one of the gravity vectors of each respective set.

Furthermore, the present invention is particularly suitable for making dynamic measurements as the surveying tool is moved along the borehole, and it is not necessary for the surveying tool carrying the apparatus of the present invention to be stationary when measurements are taken.

The present invention has a primary advantage in that it is highly resilient to shock and changes in temperature and hence is suitable for use in applications where gyroscopic techniques cannot be relied upon.

Furthermore, a further advantage in that the method and apparatus of the present invention are also resistant to magnetic interference caused by magnetic minerals in the surrounding rock. The present invention may therefore replace magnetic survey techniques using magnetometers in areas where magnetic interference is a problem.

The use of accelerometers in the present invention refers to them being used to determine the inclination and direction of a borehole. Other sensors such as magnetometers and/or gyroscopes may be used in conjunction with the present invention to give other useful surveying information such as, for example, the positions of sources of interference along the borehole e.g. ore bodies, steel pipes, formation magnetic logs etc.

BRIEF DESCRIPTION OF THE DRAWINGS

Further features and advantages of the present invention will become apparent from the following detailed description of a specific embodiment thereof, presented by way of example only, and by reference to the accompanying drawings, wherein.

DETAILED DESCRIPTION OF THE PREFERRED EMBODIMENT

Figure 1:
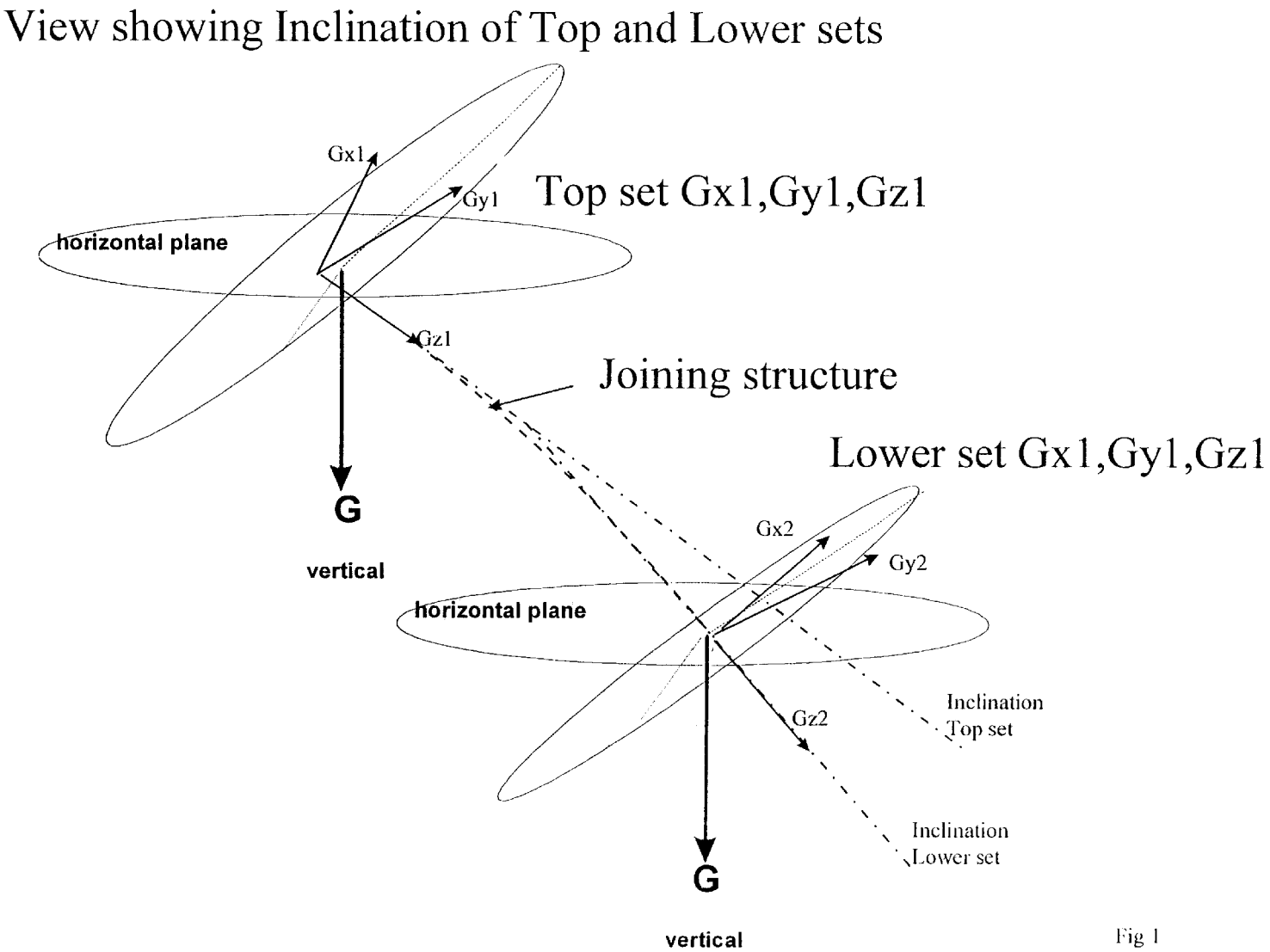
FIG. 1 shows a diagrammatic representation of the inclination of the top and lower sets of accelerometers of the present invention.

A preferred embodiment of the present invention will now be described with reference to FIG. 1 and FIG. 2.

The method and apparatus of the present invention use two sets of accelerometers 20 and 30, which are a known distance apart and are linked by a tube or other semi rigid structure 10. Each accelerometer set comprises at least two but preferably three mutually perpendicular accelerometers, with at least one accelerometer in each set having a known orientation with respect to the borehole for example, the known orientation could be achieved by arranging one of the accelerometers in the set to measure accelerations in a direction along the borehole. In the preferred embodiment each accelerometer set comprises three accelerometers, and at least one set of accelerometers are housed in the drill collar. Information from the accelerometers is transmitted to the surface by way of mud pulse, mud siren or electromagnetic (EM) techniques well known in the Measurement While Drilling (MWD) arts. Such techniques include, but are not limited to those disclosed in U.S. Pat. Nos. 5,189,045, 5,586,084, 5,583,827 and 5,160,925, which are hereby incorporated by reference. Further, the information from the accelerometers may be coded for purposes of data compression and/or error correction according to known schemes in the art.

It is important for the tube structure 10 linking the two sets of accelerometers to be capable of bending along its long axis but to resist rotation along this axis between the two sets of accelerometers. Each set of three accelerometers can be considered as determining a (Gx, Gy) plane and a pole Gz as shown in FIG. 1. In the sequence of measuring individual sections of the borehole the data from the accelerometers should preferably be as frequent or more frequent than the distance between the two sets of accelerometers. At some point in this sequence the direction of dip of one of the planes or the direction of one of the poles must be established. This applies to most instruments used in surveying i.e. a reference must be established at one point. For example, with magnetic measurements, the magnetic declination must be known, or, with north seeking gyros the spin axis of the Earth must be known.

With respect to the present invention, the reference point can be taken at the surface or at any point on the measurement line. By way of example we will consider the reference to be from the surface. From the reference point the known azimuth of the borehole is considered to be the azimuth of the long axis (the z-axis) of one of the sets of accelerometers which are positioned at the same location as the reference, i.e., the top set. By so considering then the x, y plane and the z axis pole of the top set of accelerometers now have a fixed spatial orientation. If the lower set of accelerometers also had the same orientation then it would give the same sensor outputs, and no change in either inclination or direction would be seen between the two sets.

Figure 2:
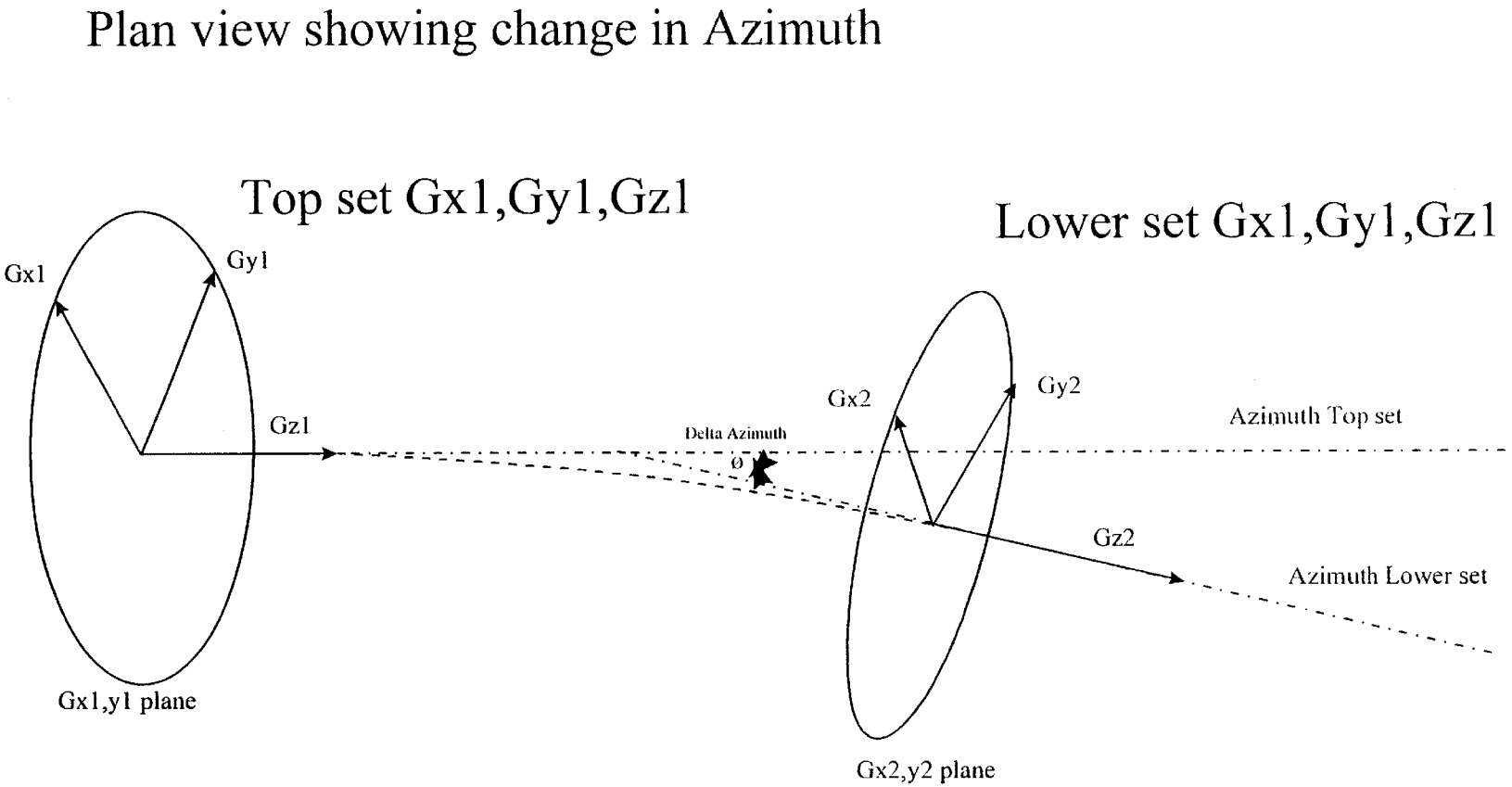
FIG. 2 shows a diagrammatic representation of a plan view of the respective axial orientations of the two sets of accelerometers.

Now, with reference to FIG. 2, consider what happens if the lower accelerometer set 20 changes direction by an amount shown as 'delta_azimuth' in FIG. 2. If the lower accelerometer set 20 had complete freedom with respect to the upper set 30 then it could still produce the same output values and the azimuth change would not be detectable. However, since the two respective accelerometer sets are joined by a structure 10 which allows only bending and not rotation along the long axis, such as a tube, then the lower accelerometer set's x, y plane cannot change dip direction without a change in some of the x, y and z accelerometer values of the set.

The method of determining the change in azimuth of the lower accelerometer set 20, and hence of the borehole, is given by the following relationships.

First, the borehole inclination (Inc1) at the position of the upper accelerometer set 30 must be found. This is given by:

$$\text{Inc}\mathbf{1}=\arctan\,(Gx1^2+Gy1^2) \qquad \text{Equation 1}$$

Gz1

Next, the borehole inclination (Inc2) at the position of the lower accelerometer set 20 must Fund. Inc2 is given by:

$$Inc2 = \arctan\frac{(Gx2^2 + Gy2^2)}{Gz2} \qquad \text{Equation 2}$$

An intermediate value beta is then found equal to:

$$Beta = \arctan \frac{\{(Gx2*Gy1 - Gy2*Gx1)*(gx1*gy1*gz1)\}}{\{Gz2(Gx1^2 + Gy1^2) + Gz1(Gx2*Gx1 + Gy2*Gy1)\}} \quad \text{Equation 3}$$

And having found the above values, the borehole azimuth at the lower accelerometer set 20 can be found by Borehole Azimuth at position of 20=ReferenceAzimuth +(Beta/(1−Sin (((Inc(1)+Inc(2))/2)))) Equation 4

Having now established the Azimuth and Inclination at the position of the lower accelerometer set (hereafter referred to as position 2), the spatial co-ordinates of the borehole between the position of the upper accelerometer set (hereafter referred to as position 1) and position 2 can be calculated using standard practices e.g. Minimum Curvature calculations. If the top set is moved to a new position between positions 1 and 2 or at position 2 then the new position 1's azimuth becomes the reference Azimuth and the procedure detailed above can be repeated.

The surveying sampling sequence can be continued for the length of borehole requiring surveying. If the survey to survey distance is less than the distance between the two sets of accelerometers then the reference azimuth can be derived by interpolation between the two known azimuths. If the new position is further than position 2 then extrapolation could be used of the bending between position 1 and 2 but this would introduce some error.

It will be appreciated that the above discussion relates to the generalized case where each set of accelerometers provides three gravity vector measurements in the x ,y and z directions. However, it will be appreciated that it is also possible to take only two gravity vector measurements, such as, for instance, in the x and y plane only, and then to solve for the third vector using a priori knowledge of the total gravitational field in the local area. Where the present invention is being used to survey boreholes drilled anywhere in the planet Earth, this total gravitational field value will be known in advance and hence for each set of accelerometers to measure the acceleration due to gravity in three directions. This reduces the number of accelerometers required to two per set which may be arranged to measure any of the x, y or z vectors, the vector not then measured being calculated by the processing means used to perform the calculations to solve for the azimuth and inclination of the borehole. For completeness, the unknown third vector from each set would be given by $$g3=(G^2-g_1^2-g_2^2) \quad \text{Equation 5}$$

wherein g3 is the unknown third vector, G is the known local total gravitational vector, and g1 and g2 are the vectors measured by the two accelerometers in each set. The third vector found from equation 5 can then be used with equations 1 to 4 to solve for the borehole azimuth and inclination as described previously.

Please note that where only two gravity vectors are to be measured by each set of accelerometers, any two vectors may be measured, the third vector then not measured being solved for as described above.

As the method and apparatus of the present invention rely on changes in acceleration to determine the gravity vector measurements, it is possible to perform dynamic measurements as the surveying tool is moved along the borehole. It is preferable that the movement of the surveying tool along the borehole be of constant speed in order to prevent any changes in speed affecting the accelerometer readings. However, it is not necessary for the surveying tool carrying the apparatus for performing the method of the present invention to be stationary when measurements are taken.

While the above description of the preferred embodiment has concentrated on a description of surveying as the surveying tool moves down the borehole, it is also conceivable that a second survey could also be performed as the tool moves back up the borehole to the surface, in which case the gravity vector measurements from the upper accelerometer set would be substituted for those from the lower accelerometer set and vice versa in the above described equations.

A further discussion on the initial referencing required for the present invention will now be undertaken. If the initial part of the borehole is vertical i.e. it can be referenced as having zero azimuth in the x-y plane with respect to a known direction, e.g., North. The apparatus is run into the borehole keeping the alignment, until the borehole has an inclination. The Azimuth can then be derived from equations 1,2 ,3 and 4. Alternatively if there is part of the borehole with a known azimuth this may be used for referencing as described earlier.

The structure between the two sets can be part of other apparatus, e.g., Wireline logging tools, MWD, LWD etc. The results may be used in conjunction with other methods for the purpose of magnetic ranging, magnetic logging and gyro quality checks etc.

With respect to rotational offsets between the two sets of accelerometers, if the two sets of accelerometers are not aligned, the rotational offset between them can be measured as an angular displacement. It is preferable that this is done when the accelerometer sets are horizontal and the z axis are aligned with a vertical borehole or hanging straight down. The rotational offset can be measured at any angle apart from vertical or near vertical. If the Z axis is not aligned then it can be compensated for, providing the Z axis misalignment can be measured.

Another way of determining the rotational offset is to solve for it if some of the azimuths within the bore hole are known. For example if two azimuths are known at x distance apart. Then the rotational offset can be solved for by changing the rotational offset until the azimuths match.

Bottom Hole Assembly (BHA) sag can cause an inclination offset between the two sets of accelerometers (e.g. caused by stabilisers). If this sag is in the vertical plane then the effect has little bearing on the calculated azimuth. However if there is a rotationally dependent offset around the Z axis, this could be corrected for by standard BHA offset correction programs.

In order to further develop and validate the present invention, the present invention has been used to survey a borehole which resulted from a test drilling in Iceland, the object of which was to penetrate geothermal reservoirs. The geologic structure in the test area was one of a faulted Grabben with many intrusive dykes and sills. The rock types in the test area varied from volcanic glass to friable pyroclastics, and in addition the area is renowned for its high degrees of magnetic interference. The effect of this magnetic interference is to deflect the readings given by magnetic survey instruments such as magnetometers, and hence the gravity based technique of the present invention is particularly applicable for surveying boreholes in areas of high magnetic interference.

Within the test drilling, both the technique of the present invention was employed as well as that of magnetic survey using magnetometers, as well as surveying using gyros. During the drilling of the test well the two sets of accelerometers 10 and 20 were placed approximately 30 meters apart, although this distance was chosen for convenience, and the two sets of accelerometers may be position either closer together or further away from each other. In addition, the distance between the accelerometers need not be kept constant throughout the survey, although preferably the distance between the accelerometers is known at all times. As the technique of the present invention requires a starting azimuth (tie-in) to be known, in the test drilling surveys from a gyro tool were used for this. In wells drilled in sedimentary formations (eg. most oilwells) the surveys from a section of the well prior to casing can be used for reference. Furthermore, as the rotation between the two sets of accelerometers must also be known, this was found during the test drilling by referencing a section of the well to the accelerometers. An alternative method would be to determine the rotation between the two sets on the surface before the tools are run into the hole, as described previously.

The results from the technique of the present invention during the test drilling generally followed the results obtained from the surveys made using the gyro technique of the prior art. The results obtained from the magnetometer surveys generally showed a large degree of error in the azimuth readings obtained as much as + or −20 from the azimuth indicated by the gyro surveys and the surveys using the present invention. The fact that the results from the present invention closely followed those from the gyros acted as an important diagnostic tool, as any differences between the two would indicate possible errors in the method and apparatus of the present invention. However, as no significant differences occurred between the gyro readings and the readings obtained from the present invention, this would indicate that the present invention is able to obtain accurate results.

From the results, as stated previously there was little difference between those obtained from the gyro readings and those from the present invention, but a few features are worthy of note. Firstly, the surveys made with the present invention were taken inside the drill collars and do not show the variations due to noise which the results from the gyro surveys show when being run inside the drill pipe. Secondly, the accelerometers used in the present invention are particularly resilient to shock and temperature changes, which can make them more suitable than gyros in certain drilling applications. In addition, and especially in volcanic regions such as Iceland, the resistance against magnetic interference which is inherent in the present invention also means that the present invention can replace magnetometer surveys in such regions. The only drawback of the present invention which must be noted is that the technique uses the results of a previous survey as a reference for the next, with the consequence that the present invention may accumulate errors over time, although this is only thought to be a significant problem in long sections of well where the accumulative errors may begin to impact. In conclusion, therefore, the test drilling made in Iceland has shown that the present invention provides a new and valuable survey technique which can be used in conjunction or alternatively with magnetic and gyroscopic techniques to determine azimuth and inclination at any position along the borehole. The present invention is particularly suitable for use in areas of high magnetic interference where magnetometers would be unsuitable, or in applications where sufficient stability for gyros cannot be guaranteed.

As a final point it will be understood that the method and apparatus of the present invention may be the only subterranean surveying technique that can be used in regions of substantially no magnetic field and no spin. Such regions can occur on the Earth near to the poles, where the magnetic field is confused and because of the proximity of the spin axis of the Earth there is little actual movement of a particular point on the Earth. As an aside, such conditions also occur on the Moon, which has no magnetic field and little rotational spin. The above described effects can cause the use of magnetometers and gyros in such regions to be unpredictable, and hence the gravity based accelerometer technique of the present invention may be the only feasible alternative.

What is claimed is:

1. A method for determining a tool inclination and azimuth in a borehole in an earth formation, said tool having a first and second gravity measurement devices mounted therein, comprising the steps of:

(a) aligning at least one of said gravity measurement devices with a known reference azimuth;

(b) positioning said tool in said borehole, said first device being positioned at a first position and second device at a second position in said borehole, said first and second devices being constrained from rotating with respect to each other;

(c) measuring a first and a second set of gravity vectors using said first and second devices, respectively;

(d) determining the inclination and azimuth of said tool at said first position in said borehole from said first and second sets of gravity vectors.

2. The method of claim 1, wherein steps (b) through (d) may be repeated at one or more positions in the borehole to determine tool inclination and azimuth at multiple positions along said borheole.

3. The method of claim 1, wherein the step (c) comprises measuring two gravity vectors for each set, said gravity vectors within a set being mutually perpendicular.

4. The method of claim 3, wherein step (d) further includes the step of deriving a third gravity vector for each set, based on said two gravity vectors for each set and a known total gravitational field for the earth formation, said gravity vectors for a set being mutually orthogonal.

5. The method of claim 4, wherein the said third gravity vector is derived according the equation:

$$g_3=\sqrt{(G^2-g_1^2-g_2^2)}$$

where $g_3$ is the derived gravity vector, G is the known total gravitational field for the earth formation, and $g_1$ and $g_2$ are two measured gravity vectors.

6. The method of claim 1, wherein step (c) comprises measuring three gravity vectors for each set, said gravity vectors within a set being mutually orthogonal.

7. The method of claim 1, wherein both gravity measurement devices are aligned with the known reference azimuth.

8. The method of claim 1, wherein both gravity measurement devices wherein the gravity vectors within each set are rotationally aligned with respect to each other.

9. The method of claim 1, wherein step (c) comprises measuring said gravity vector sets utilizing accelerometers.

10. The method of claim 1, wherein said first and second gravity measurement devices are mounted in said tool at a known distance from each other.

11. The method of claim 1, wherein step (d) of determining the inclination of said tool at said first position, further includes:

determining tool inclination at said first position according to the equation:

$$Inc1 = \arctan \frac{\sqrt{(g_{x1}^2 + g_{y1}^2)}}{g_{z1}}$$

where $g_{x1}$, $g_{y1}$, and $g_{z1}$ are the gravity vectors determined at said first position by said gravity measurement device in the x, y, and z axes, respectively.

12. The method of claim 11, wherein step (d) further includes determining the inclination of said tool at said second position according to the formula:

$$Inc2 = \arctan \frac{\sqrt{(g_{x2}^2 + g_{y2}^2)}}{g_{z2}}$$

where $g_{x2}$, $g_{y2}$, and $g_{z2}$ are the gravity vectors determined at said second position by said gravity measurement device in the x, y, and z axes, respectively.

13. The method of claim 12, wherein the tool azimuth a said first position (Ap1) is determined according to the formula:

$$A_{p1}=A_R+(\beta/(1-\sin((Inc1+Inc2)/2))),$$

where $$\beta = \arctan \frac{(g_{x2}g_{y1} - g_{y2}g_{x1})\sqrt{g_{x1}g_{y1}g_{z1}}}{g_{z2}(g_{x1}^2 + g_{y1}^2) + g_{z1}(g_{x2}g_{x1} + g_{y2}g_{y1})}$$

and $A_R$ is the reference azimuth.

14. An apparatus for determining the inclination and azimuth of a tool in a borehole traversing an earth formation, comprising:

(a) a first and second gravity measurement devices, said devices being axially positioned with respect to said tool and offset from each other and constrained from rotational movement with respect to each other, wherein said first and second devices each measure a set of gravity vectors at a first and second position in said borehole, respectively, each set comprising at least two perpendicular gravity vectors; and (b) a processor to determine the inclination and azimuth of said tool with respect to an azimuthal reference based on said sets of gravity vectors.

15. The apparatus of claim 14, wherein said first and second measurement devices are mounted on said tool body.

16. The apparatus of claim 14, further including means for positioning said tool and said gravity measurement devices in said borehole.

17. The apparatus of claim 14, wherein each gravity vector set is comprised of three mutually orthogonal gravity vectors.

* * * * *